US012426715B2

(12) United States Patent
Kamiya et al.

(10) Patent No.: US 12,426,715 B2
(45) Date of Patent: Sep. 30, 2025

(54) ARMREST

(71) Applicant: TOYOTA BOSHOKU KABUSHIKI KAISHA, Aichi-ken (JP)

(72) Inventors: Shinji Kamiya, Aichi-ken (JP); Akihisa Ninomiya, Aichi-ken (JP)

(73) Assignee: TOYOTA BOSHOKU KABUSHIKI KAISHA, Aichi-Ken (JP)

( * ) Notice: Subject to any disclaimer, the term of this patent is extended or adjusted under 35 U.S.C. 154(b) by 184 days.

(21) Appl. No.: 18/228,339

(22) Filed: Jul. 31, 2023

(65) Prior Publication Data

US 2024/0049885 A1 Feb. 15, 2024

(30) Foreign Application Priority Data

Aug. 12, 2022 (JP) ..... 2022-128772

(51) Int. Cl.
*A47C 7/54* (2006.01)
*A47C 7/74* (2006.01)

(52) U.S. Cl.
CPC ..... *A47C 7/54* (2013.01); *A47C 7/748* (2013.01)

(58) Field of Classification Search
CPC ..... A47C 7/54; A47C 7/748
See application file for complete search history.

(56) References Cited

U.S. PATENT DOCUMENTS 10,555,372 B2 * 2/2020 Ji ..... B60N 2/5621
2011/0163576 A1 7/2011 Akai et al.

FOREIGN PATENT DOCUMENTS

| | | | |
|---|---|---|---|
| JP | 5603466 | | 10/2014 |
| JP | 2018065433 | A * | 4/2018 |
| KR | 20160052889 | A * | 5/2016 |
| WO | WO-2022064727 | A1 * | 3/2022 |

* cited by examiner

*Primary Examiner* — Anthony D Barfield
(74) *Attorney, Agent, or Firm* — Greenblum & Bernstein, P.L.C.

(57) ABSTRACT

An armrest includes a base member serving as a framework, a cushioning pad provided on the base member, a cover wrapping the base member and the cushioning pad, and a planar heater disposed such that an electric heating wire is laid between the cushioning pad and the cover. The base member has an outer peripheral surface having a curved surface that is curved downward from an upper surface of the base member. The cushioning pad has a curved cover that covers the outer peripheral surface of the base member across the upper surface and the curved surface. The heater has a curved portion disposed such that the heating wire is laid between the curved cover and the cover.

4 Claims, 9 Drawing Sheets

ARMREST

CROSS REFERENCE TO RELATED APPLICATION

This application is based on Japanese Patent Applications No. 2022-128772 filed on Aug. 12, 2022, the entire contents of which are incorporated herein by reference.

TECHNICAL FIELD

The present invention relates to an armrest. More specifically, the present invention relates to an armrest provided with a heater having inside an electric heating wire serving as a heat source.

BACKGROUND ART

JP5603466B discloses a configuration in which a planar heater is incorporated in an armrest of a vehicle seat. The heater has a configuration in which an electric heating wire is sewn to a planar base fabric. The heater is disposed between a pad inside the armrest and a cover that covers the surface of the pad.

In the related art described above, when an arm or a hand is placed on the armrest, the heating wire of the heater is pressed against the base member inside the armrest. Therefore, when the surface of the base member is uneven, an excessive bending load may be applied to the heating wire of the heater. An object of the present invention is to provide an armrest capable of reducing a bending load applied to a heating wire of a heater.

SUMMARY

As a solution for solving the above matters, the armrest of the present invention has the following solution.

(1) According to an aspect of the invention, an armrest includes a base member serving as a framework, a cushioning pad provided on the base member, a cover wrapping the base member and the cushioning pad, and a planar heater disposed such that an electric heating wire is laid between the cushioning pad and the cover. The base member has an outer peripheral surface having a curved surface that is curved downward from an upper surface of the base member. The cushioning pad has a curved cover that covers the outer peripheral surface of the base member across the upper surface and the curved surface. The heater has a curved portion disposed such that the heating wire is laid between the curved cover and the cover.

According to the first aspect of the present invention, the curved portion of the heating wire laid over the curved surface of the base member is elastically supported by the curved cover of the pad interposed between the curved portion and the curved surface. As a result, it is possible to reduce the bending load applied by the heating wire to the curved portion when an arm or a hand is placed on the armrest.

(2) In the armrest of (1) the curved cover is an outer corner between a top region forming a cushion of the upper surface of the cushioning pad and a side plate region forming a cushion of a side surface in a width direction of the cushioning pad, and the heater is disposed such that the heating wire is laid across the top region and the side plate region of the cushioning pad.

According to the second aspect of the present invention, the heating wire of the heater can be laid over a wide range of the upper surface and the side surface of the armrest so as not to apply an excessive bending load.

(3) In the armrest of (2), the cushioning pad includes a top pad forming a cushion of the top region, and a side pad that is immediately adjacent to the top pad in the width direction and that forms a cushion of the side plate region including the outer corner, and the top pad is softer than the side pad.

According to the third aspect of the invention, it is possible to appropriately shape the side surface including the outer corner while enhancing the soft feeling of the upper surface. In addition, since the top pad is supported from the lateral side by the side pad adjacent in the width direction, the stability of the support to the arm or the hand placed on the upper surface can be improved.

(4) In the armrest of (3), a top plate supporting the top pad of the base member is formed with a fitting recess fitted with the top pad.

According to the fourth aspect, the top pad can be assembled in a state of being positioned on the top plate. Accordingly, it is possible to further improve the stability of the support to the arm or the hand placed on the upper surface.

(5) In the armrest of (2), the cushioning pad includes a body pad forming a cushion of the top region and the side plate region including the outer corner, and a stacked pad stacked in a recess on the top region of the body pad, the stacked pad and the body pad forming a cushion of the top region, and the stacked pad is softer than the body pad.

According to the fifth aspect of the present invention, it is possible to appropriately adjust the cushioning property of the upper surface by overlapping on the body pad the stacked pad, which is softer than the body pad. Further, since the stacked pad is supported from the periphery by the body pad, the stability of the support to the arm or the hand placed on the upper surface can be improved.

DETAILED DESCRIPTION OF EMBODIMENTS

Figure 1:
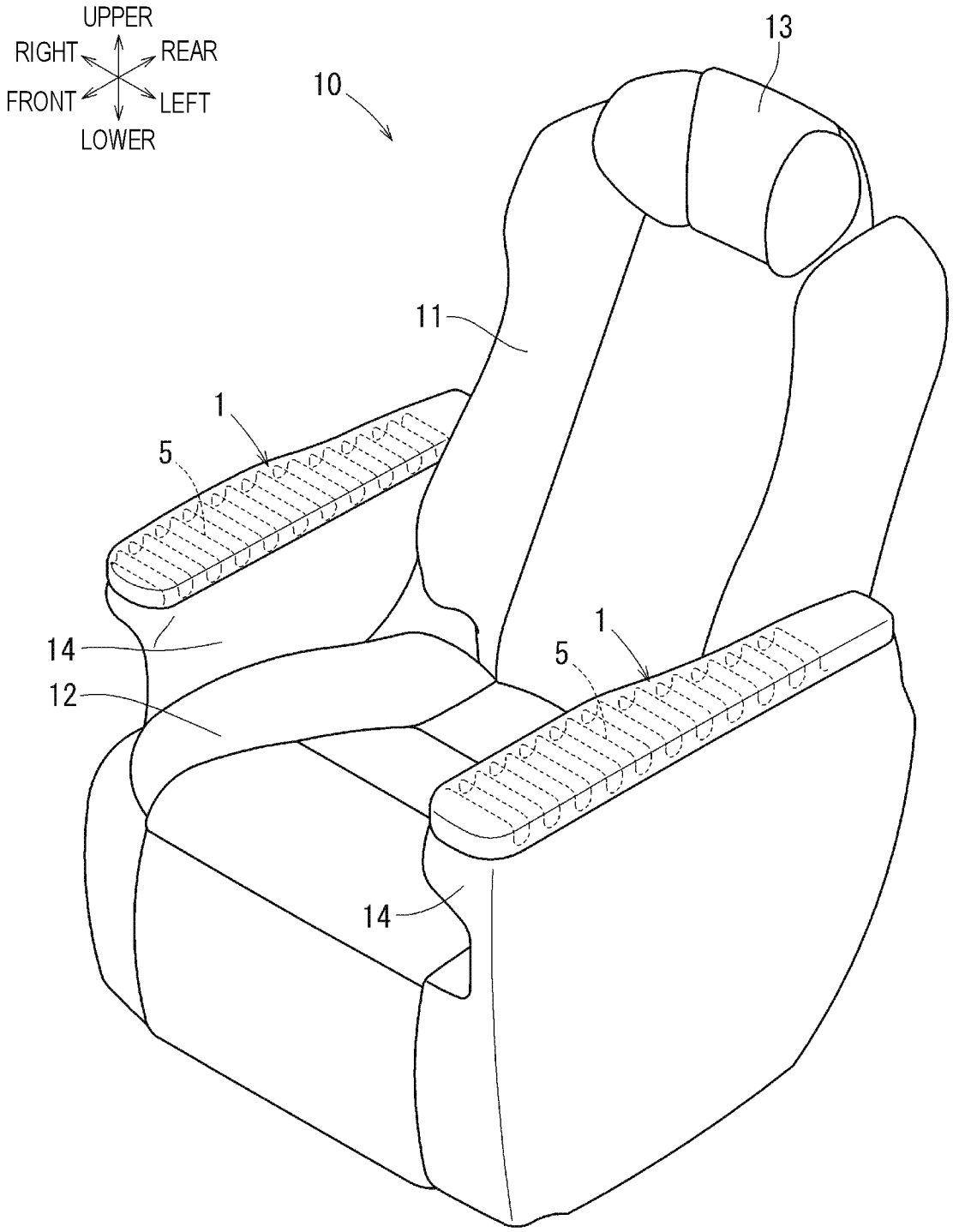
FIG. 1 is a perspective view illustrating a schematic configuration of an armrest according to a first embodiment.

In the following, embodiments relating to this disclosure will be described with reference to the drawings.

FIRST EMBODIMENT

Schematic Configuration of Armrest 1

First, a configuration of an armrest 1 according to a first embodiment of the present invention will be described with reference to FIGS. 1 to 5. Meanwhile, in the following description, the directions such as the front-rear, upper-lower, and right-left directions refer to the respective directions as indicated in the drawings. In addition, in the following description, in a case where no specific reference drawing is not illustrated, or in a case where there is no corresponding reference sign in the reference drawing, any one of FIGS. 1 to 5 is referred to as appropriate.

As shown in FIG. 1, an armrest 1 according to the present embodiment is applied to a seat 10 of an automobile. The seat 10 is configured as a so-called captain seat for one person. Specifically, the seat 10 includes a seat back 11 serving as a backrest portion of a seated occupant, a seat cushion 12 serving as a seating portion, and a headrest 13 serving as a head support portion. The seat back 11 is connected to the rear end of the seat cushion 12, allowing adjustment of the backrest angle via a recliner (not shown).

The seat 10 includes a pair of side walls 14 erected in a wall shape from both the left and right sides of the seat cushion 12. The seat 10 includes, on each of the upper portions of the pair of side walls 14, an armrest 1 allowing the seated occupant to place an arm or a hand thereon. Each of the armrests 1 has a cushioning property that enables flexible support to the arm or hand of the seated occupant.

Figure 2:
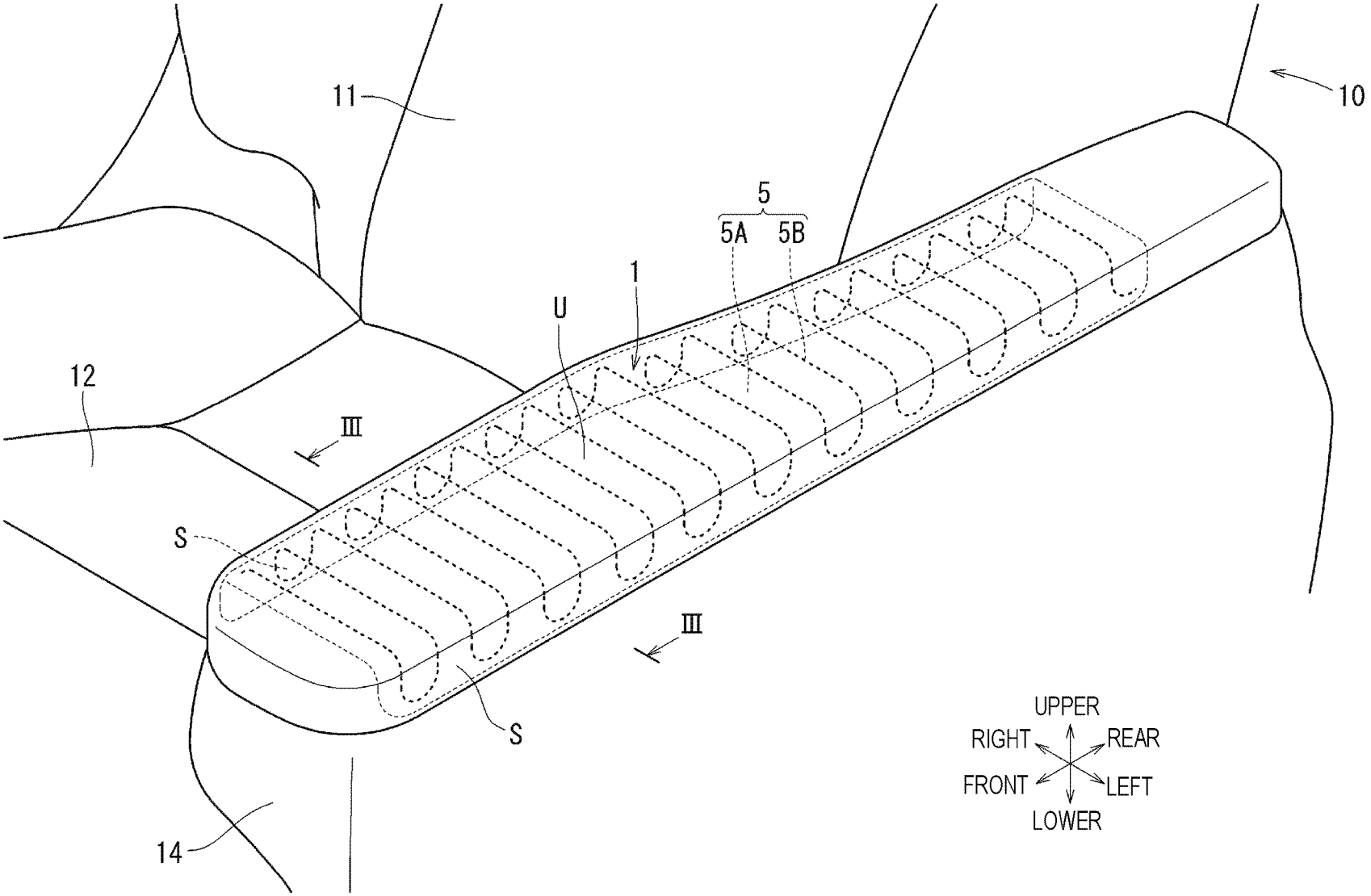
FIG. 2 is an enlarged perspective view of the main part of FIG. 1.

As shown in FIG. 2, each of the armrests 1 includes a planar heater 5 capable of warming up the upper surface U thereof. Each heater 5 is laid in a manner across the upper surface U and the left and right side surfaces S of each armrest 1. Thus, in addition to the arms or hands placed on the upper surfaces U thereof, the armrests 1 can also warm the fingertips of the left and right hands extending to grip the side surfaces S of the armrests 1.

Specifically, each heater 5 is laid in a manner extending over substantially the entire area of each armrest 1 in the front-rear direction, across the upper surface U and the side surfaces S. Therefore, even when the position of the arm or the hand of the seated occupant on each armrest 1 is shifted rearward due to the rearward tilting of the seat back 11, the left and right arms, hands, and fingertips of the seated occupant can be widely heated by the respective heaters 5.

When the arms or hands of the seated occupant are lowered inward from each armrest 1, the arms of the seated occupant can be warmed in a wide range in the front-rear direction by the heaters 5 laid on the inner side surfaces S of the armrests 1. Hereinafter, a specific configuration of each part of the armrests 1 will be described in detail. The armrests 1 have substantially the same basic configuration. Therefore, hereinafter, the configuration of the armrest 1 on the left side shown in FIG. 2 will be described in detail as a representative.

Configuration of Each Part of Armrest 1

Figure 3:
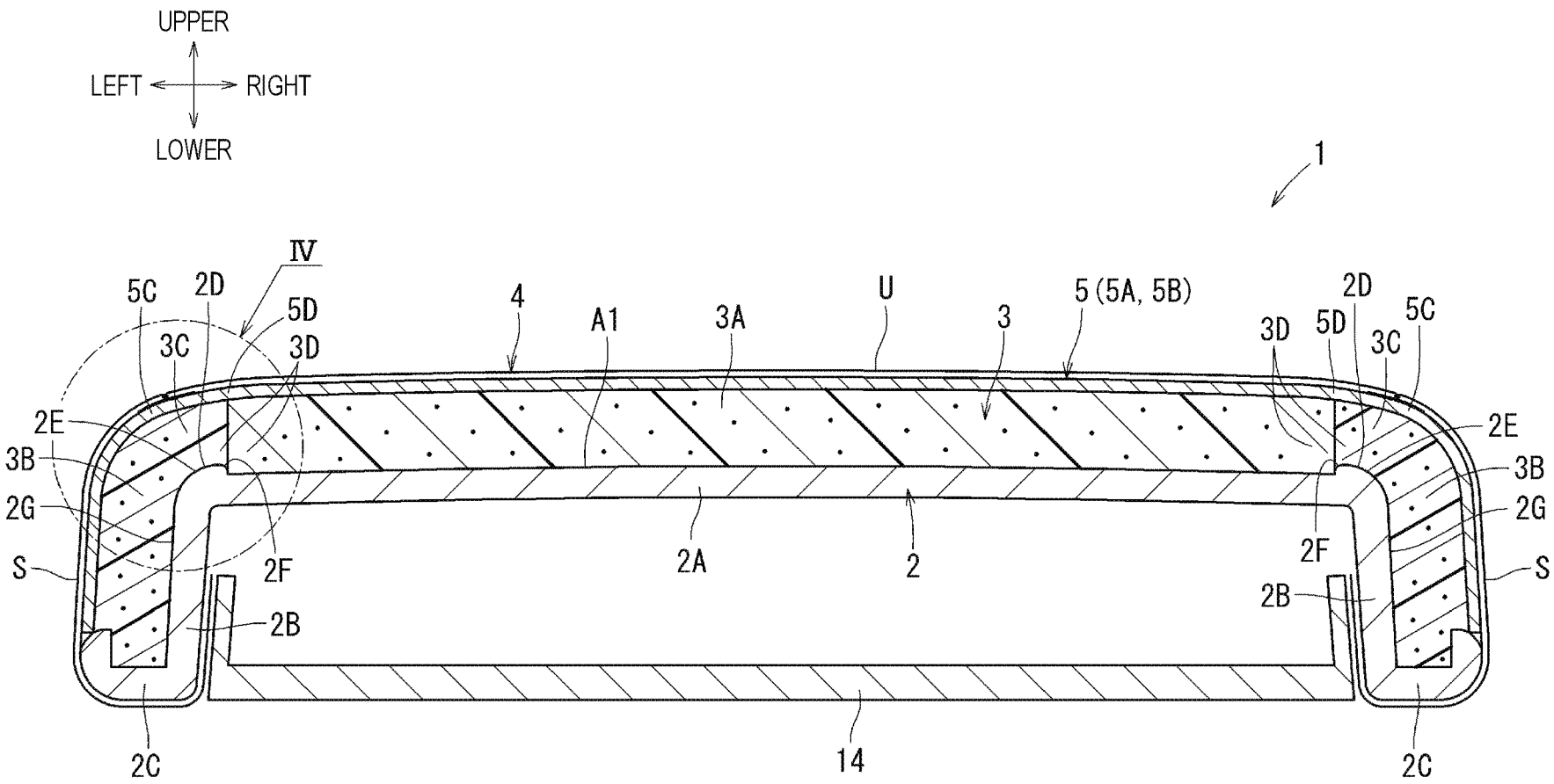
FIG. 3 is a cross-sectional view taken along line III-III in FIG. 2.

The armrest 1 is formed in a flat plate shape extending in an elongated shape in the front-rear direction along the upper portions of the side walls 14 described above. Specifically, as shown in FIG. 3, the armrest 1 includes a base member 2 serving as a framework, a cushioning pad 3 provided on the base member 2, and a cover 4 wrapping the base member 2 together with the pad 3. The armrest 1 has a planar heater 5 laid between the pad 3 and the cover 4.

The base member 2 is constituted by a plate-shaped resin component obtained by injection molding. The base member 2 is assembled along the upper ends of the side walls 14. Specifically, the base member 2 includes a plate-shaped top plate 2A that forms a framework along the upper surface U of the armrest 1. In addition, the base member 2 has flat plate-shaped side plates 2B extending downward from the left and right side edges of the top plate 2A. Each side plate 2B forms a framework along the corresponding side surface S of the armrest 1. In addition, the base member 2 has fins 2C extending outward in the width direction (away from each other) from the end portions of the downward extension of the side plates 2B.

Figure 4:
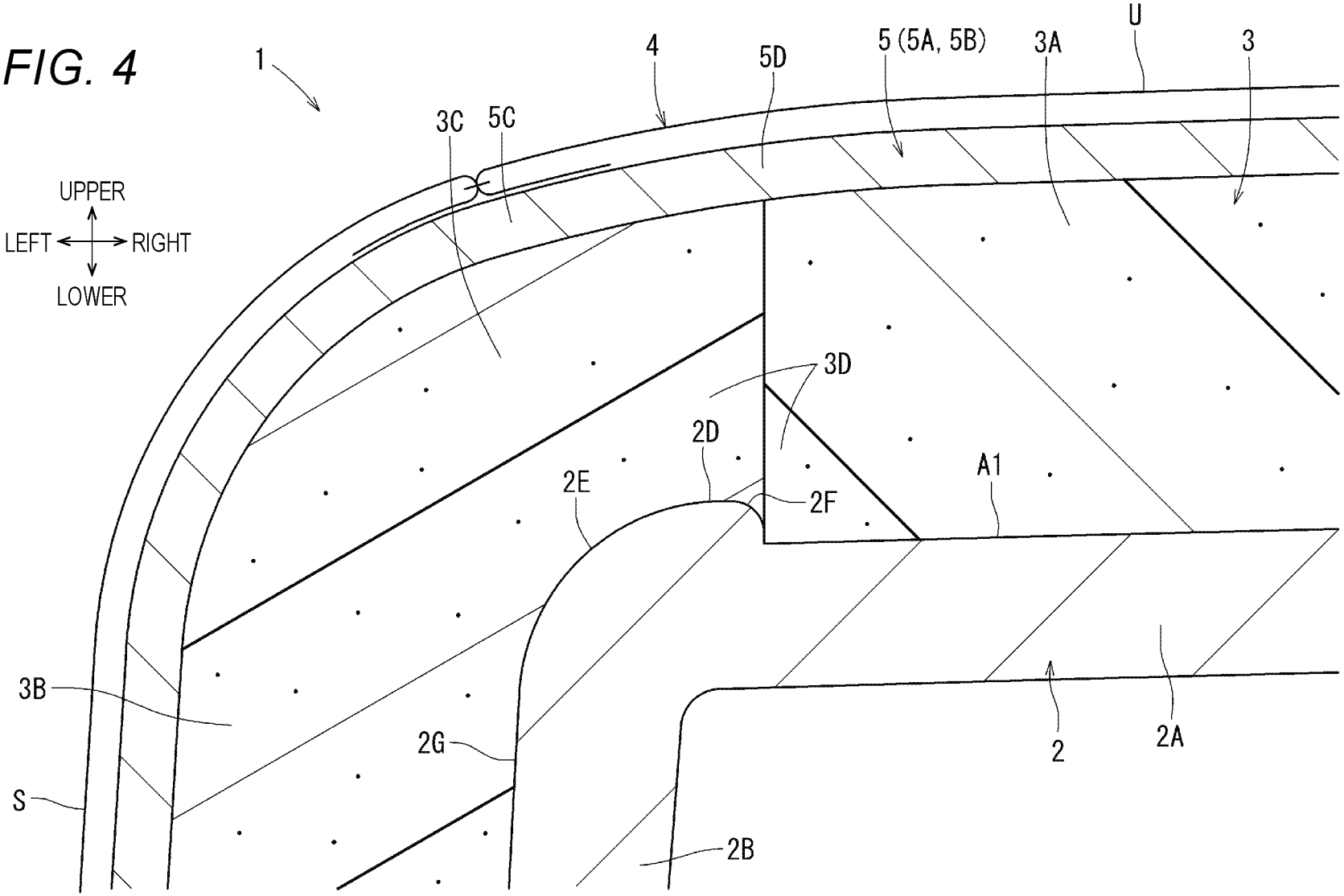
FIG. 4 is an enlarged view of a portion IV in FIG. 3.

According to the above-described configuration, the base member 2 is configured such that the outer corners of the top plate 2A and the side plates 2B extending downward from the respective side edges of the top plate 2A are each formed with a curved surface 2E having a curved shape. As illustrated in FIG. 4, each curved surface 2E is configured as a surface curved downward from the upper surface 2D of the top plate 2A.

As shown in FIG. 3, the upper surface of the top plate 2A is formed with, over substantially the entire region in the left-right direction, a fitting recess A1 having a rectangular shape in a plan view and slightly recessed downward. The fitting recess A1 is a slight recess that is about half or less of the plate thickness dimension of the top plate 2A. As the fitting recess A1 is formed, both the upper corners of the fitting recess A1 of the top plate 2A are respectively formed with curved surfaces 2F in a curved shape. As illustrated in FIG. 4, each curved surface 2F is configured as a surface curved downward from the upper surface 2D of the top plate 2A.

As shown in FIG. 3, the pad 3 includes a top pad 3A made of slab urethane and a pair of left and right side pads 3B made of chip urethane. The pad 3 is set on the base member 2, with the top pad 3A and the pair of left and right side pads 3B covering the outer peripheral surface of the base member 2 without a gap. Specifically, the top pad 3A is set on the top plate 2A of the base member 2, and the side pads 3B are set covering the side plates 2B from the outer sides in the width direction.

Specifically, the top pad 3A is cut into a rectangular plate shape in a plan view along the recessed shape of the fitting recess A1 formed in the top plate 2A. The top pad 3A is set such that the entire lower portion thereof is fitted into the fitting recess A1 from above, and the entire upper portion thereof bulges upward from the fitting recess A1. As a result, the top pad 3A forms a top region of the pad 3 forming a cushion of the upper surface U of the armrest 1.

Each side pad 3B is formed in a plate shape having an inverted L-shaped cross section. Specifically, the side pad 3B is formed into a plate shape having an inverted L-shaped cross section having, continuous to each other, a portion set on the upper surface 2D of the top plate 2A in a manner immediately adjacent to the top pad 3A in the width direction, and a portion set to cover the side plate 2B from the outside in the width direction. The side pad 3B is set along the outer peripheral surface of the base member 2 such that the vertical sides of the L shape is in contact with the upper surface of the fin 2C and the outer side surface 2G of the side plate 2B.

The side pad 3B is set such that the horizontal side of the L shape is in contact with the upper surface 2D of the top plate 2A of the base member 2 and is pressed against the top pad 3A from the outer side in the width direction. As a result, the side pad 3B forms a side plate region of the pad 3 forming a cushion of the corresponding side surface S of the armrest 1. The side pad 3B forms a cushion of a part of the upper surface U of the armrest 1 (the side edge in the width direction) together with the top pad 3A.

According to the above configuration, in the side pad 3B, the corner connecting the vertical side and the horizontal side of the L shape is configured as a curved cover 3C that covers the curved surface 2E of each of both the outer corners of the base member 2. As shown in FIG. 4, each curved cover 3C continuously covers the curved surface 2E across the upper surface 2D of the top plate 2A and the outer side surface 2G of the side plate 2B.

The pad 3 has a curved cover 3D constituted at each top plate portion where the side pad 3B and the top pad 3A are abutted against each other in an adjacent manner. The curved cover 3D covers the curved surface 2F of each of both upper corners of the fitting recess A1 of the base member 2. Specifically, the curved cover 3D covers the curved surfaces 2F continuously across the upper surface 2D of the top plate 2A and the inner side surface of the fitting recess A1.

According to the configuration described above, the pad 3 covers the outer peripheral surface of the base member 2 without a gap, and reduces the uncomfortable feeling at the time of using the curved surfaces 2E and the curved surfaces 2F, which are convex edges. The pad 3 has a configuration in which the top pad 3A made of slab urethane and forming a cushion of the upper surface U is softer than the side pads 3B made of chip urethane and forming a cushion of the side surfaces S. As a result, the pad 3 is configured such that the soft feeling of the upper surface U is enhanced by the softer top pad 3A, and the shape of the side surfaces S and the outer corners of the armrest 1 can be appropriately set by the harder side pads 3B.

Since the top pad 3A of the pad 3 is fitted into the fitting recess A1 of the top plate 2A of the base member 2, the top pad 3A is less likely to be displaced in the width direction with respect to the base member 2. Further, since the top pad 3A is pressed against the harder side pads 3B from both outer sides in the width direction, the pad 3 is less likely to be displaced in the width direction. Accordingly, the pad 3 is configured such that the top pad 3A is less likely to be moved to the left or right when an arm or a hand is placed on the upper surface U, and the arm or hand can be appropriately supported at a fixed position.

As shown in FIG. 3, the cover 4 is configured such that a plurality of cover pieces formed in accordance with the shapes of the upper surface U and the side surfaces S of the armrest 1 are sewn into one. The cover 4 is placed on the base member 2 to cover the outer peripheral surface of the pad 3 from above after the pad 3 is assembled onto the base member 2.

The cover 4 is fixed to the back surface of the base member 2 by drawing the ends after covering to the back side (lower side) of the base member 2. As a result, the cover 4 is stretched in a state of being widely in close contact with the outer peripheral surface of the pad 3, and holds the pad 3 in a state of being widely in close contact with the outer peripheral surface of the base member 2.

The heater 5 has a planar structure in which a heating wire 5B made of nichrome wire is laid widely in a zigzag manner on a planar base fabric 5A formed of a nonwoven fabric. The heating wires 5B are laid in a zigzag shape along the back surface of the base fabric 5A, and multiple positions thereof are sewn and fixed to the base fabric 5A. The heater 5 is disposed as follows, so that the left and right side surfaces S are warmed in addition to the upper surface U of the armrest 1.

That is, the heater 5 is extended to a size to be laid across the top pad 3A and the side pads 3B, and is laid between the top pad 3A and the side pads 3B, and the cover 4 wrapping the top pad 3A and the side pads 3B. As a result, as shown in FIG. 4, the heater 5 has the curved portions 5C such that the heating wire 5B is laid in a curved shape between the cover 4 and the curved cover 3C at each of both the outer corners of the pad 3. That is, the heater 5 includes the curved portions 5C arranged such that the heating wires 5B are applied to the curved surfaces 2E of the outer corners of the base member 2 described above.

The heater 5 includes the curved portions 5D disposed such that the heating wire 5B is laid between the cover 4 and each of the curved covers 3D formed by the abutting portions of the top pad 3A and the side pads 3B of the pad 3. That is, the heater 5 includes the curved portions 5D arranged such that the heating wire 5B is applied to the curved surfaces 2F of the upper corners of the fitting recessed portion A1 of the base member 2 described above.

Figure 5:
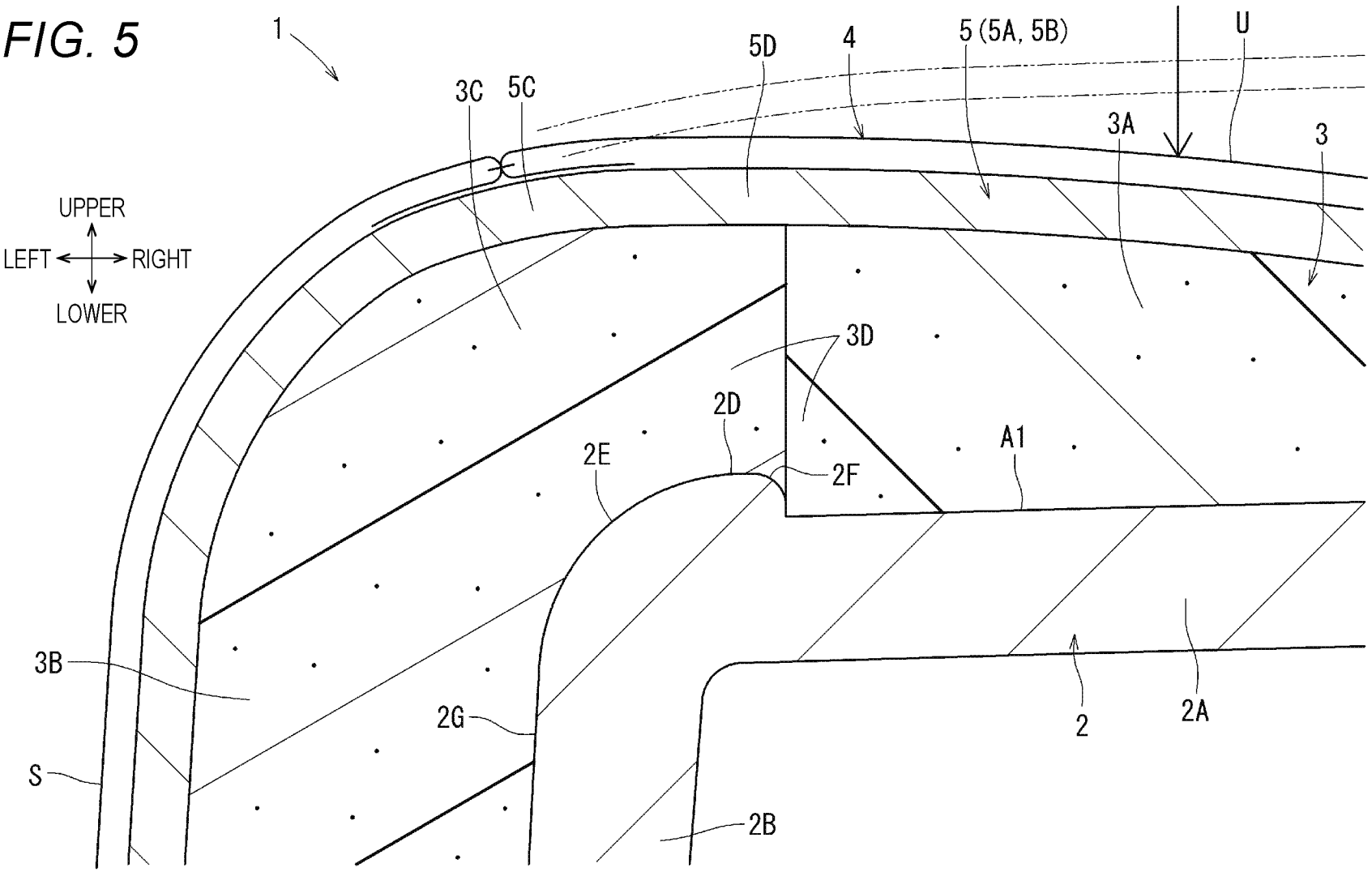
FIG. 5 is a cross-sectional view corresponding to FIG. 4, illustrating a modified aspect when an arm or a hand is placed on the upper surface of the armrest.

According to the above configuration, as illustrated in FIG. 5, when an arm or hand of a seated occupant is placed on the upper surface U of the armrest 1, the heater 5 is applied a bending load at the curved portions 5C and 5D. However, in the heater 5, the curved portions 5C and 5D are elastically supported from the rear side in a wide planar shape by the respective curved covers 3C and 3D of the pad 3.

Therefore, the heater 5 is elastically supported by the curved covers 3C and 3D of the pad 3 interposed between the curved portions 5C and 5D and the curved surfaces 2E and 2F, and thus is prevented from being locally bent but is deformed to the extent of being curved with a gentle curvature as a whole even when the curved portions 5C and 5D are subjected to such a load to be bent about the curved surfaces 2E and 2F of the base member 2. Therefore, it is possible to prevent an excessive bending load from being applied to the curved portions 5C and 5D, even when the heating wire 5B of the heater 5 is laid over a wide range extending across the upper surface U and the side surfaces S of the armrest 1.

The heater 5 is disposed such that the heating wire 5B is laid over the back surface of the base fabric 5A. The base fabric 5A faces the cover 4, and the heating wire 5B faces the pad 3. According to such a configuration, a highlight line due to the projection of the heating wire 5B is less likely to be exposed on the surface of the cover 4. In addition, when an arm or hand is placed on the upper surface U, the uncomfortable feeling due to the projection of the heating wire 5B is less likely to be sensed.

To summarize the above, the armrest 1 according to the present embodiment may have the following configuration. In the following description, reference numerals assigned in parentheses correspond to the configurations described in the above embodiment.

That is, the armrest (1) includes: a base member (2) serving as a framework; a cushioning pad (3) provided on the base member (2); a cover (4) wrapping the base member (2) together with the pad (3); and a planar heater (5) disposed such that the heating wire (5B) is laid between the pad (3) and the cover (4). The base member (2) has an outer peripheral surface having a curved surface (2E, 2F) that is curved downward from the upper surface (2D) thereof. The pad (3) has a curved cover (3C, 3D) that covers the outer peripheral surface of the base member (2) across the upper surface (2D) and the curved surface (2E, 2F). The heater (5) has a curved portion (5C, 5D) disposed such that the heating wire (5B) is laid between the curved cover (3C, 3D) and the cover (4).

According to the above configuration, the curved portion (5C, 5D) of the heating wire (5B) laid over the curved surface (2E, 2F) of the base member (2) is elastically supported by the curved cover (3C, 3D) of the pad (3) interposed between the curved surface (2E, 2F) and the curved portion (5C, 5D). As a result, the bending load applied to the curved portions (5C, 5D) of the heating wire (5B) when an arm or hand is placed on the armrest (1) can be reduced.

The curved cover (3C) is an outer corner between a top region forming a cushion of the upper surface (U) and a side plate region forming a cushion of a side surface (S) in the width direction of the pad (3). The heater (5) is disposed such that the heating wire (5B) is laid across the top region and the side plate region of the pad (3). According to the above configuration, the heating wire (5B) of the heater (5) can be laid over a wide range of the upper surface (U) and the side surface (S) of the armrest (1) so as not to apply an excessive bending load.

The pad (3) includes a top pad (3A) forming a cushion of the top region, and a side pad (3B) that is immediately adjacent to the top pad (3A) in the width direction and that forms a cushion of a side plate region including the outer corner. The top pad (3A) is softer than the side pad (3B). According to the above configuration, it is possible to appropriately shape the side surface (S) including the outer corner while enhancing the soft feeling of the upper surface (U). In addition, since the top pad (3A) is supported from the lateral side by the side pad (3B) immediately adjacent in the width direction, the stability of the support to the arm or the hand placed on the upper surface (U) can be improved.

A top plate (2A) supporting the top pad (3A) of the base member (2) is formed with a fitting recess (A1) fitted with the top pad (3A). According to the above configuration, the top pad (3A) can be assembled in a state of being positioned on the top plate (2A). Accordingly, it is possible to further improve the stability of the support to the arm or the hand placed on the upper surface (U).

SECOND EMBODIMENT

Figure 6:
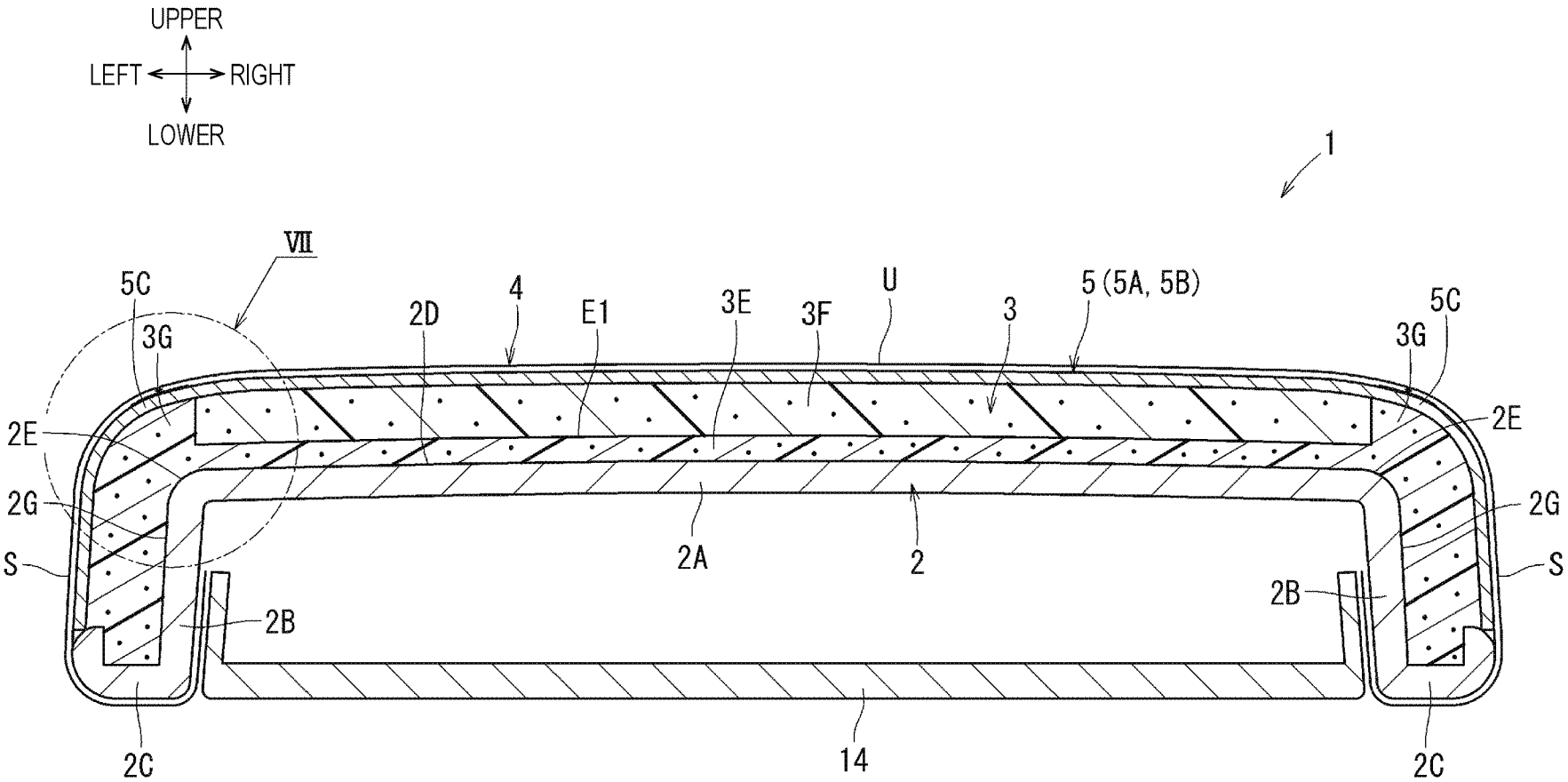
FIG. 6 is a cross-sectional view corresponding to FIG. 3, illustrating a configuration of an armrest according to a second embodiment.
Figure 7:
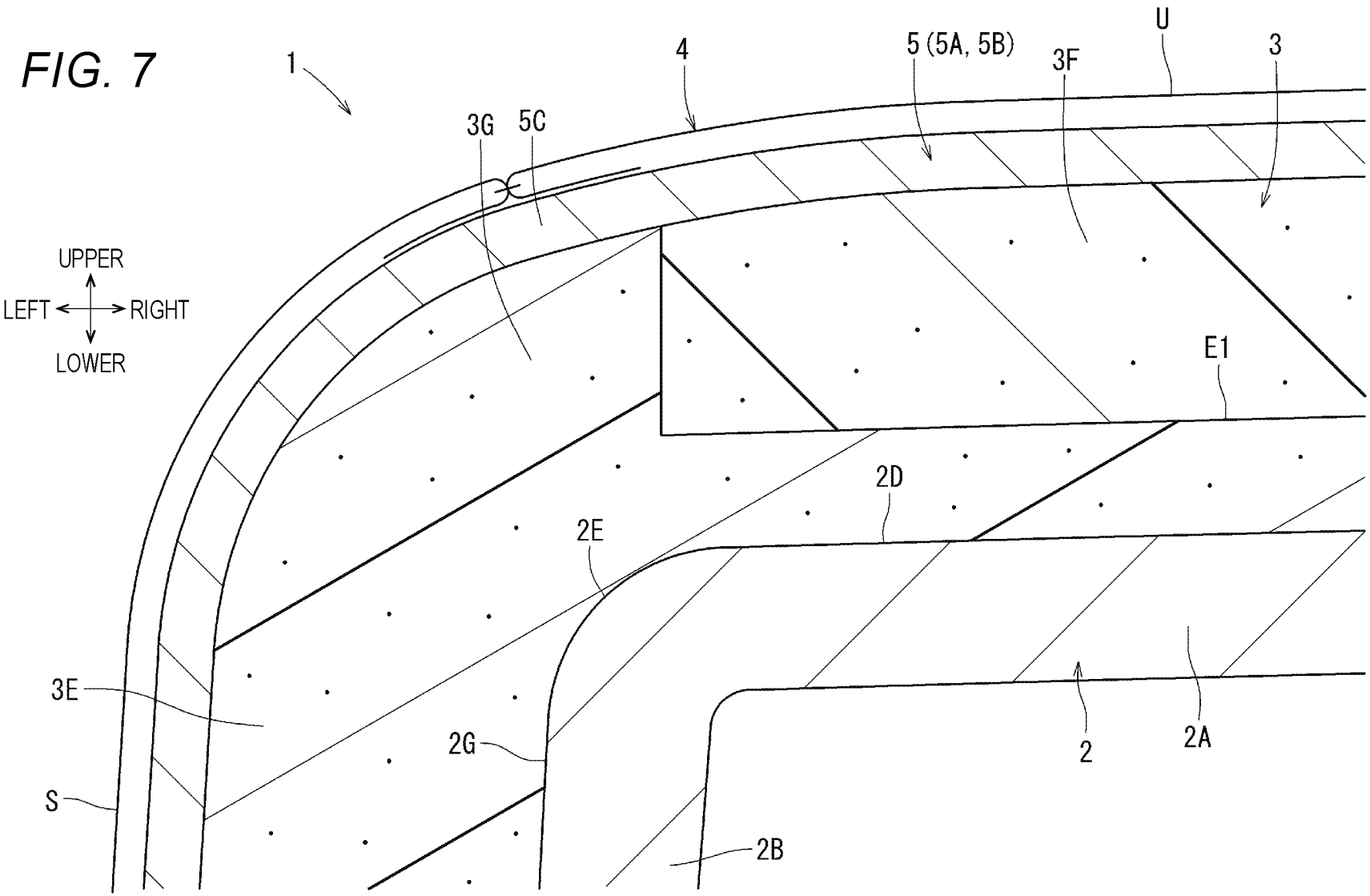
FIG. 7 is an enlarged view of a portion VII in FIG. 6.

Next, a configuration of an armrest 1 according to a second embodiment of the present invention will be described with reference to FIGS. 6 to 7. As shown in FIG. 6, the armrest 1 according to the present embodiment is different from the configuration shown in the first embodiment in that the pad 3 includes a body pad 3E made of slab urethane and a stacked pad 3F made of chip urethane. In addition, the top plate 2A of the base member 2 has a smooth upper surface shape that does not include the fitting recess A1 (see FIG. 3) described in the first embodiment.

The body pad 3E is formed in a plate shape having an inverted U-shaped cross section along the outer peripheral surface of the base member 2. The body pad 3E is set along the outer peripheral surface of the base member 2 so as to be in contact with the upper surfaces of the fin 2C of the base member 2, the outer side surfaces 2G of the side plates 2B, and the upper surface 2D of the top plate 2A. As a result, the body pad 3E forms a top region of the pad 3 forming a cushion of the upper surface U of the armrest 1, and also forms side plate regions of the pad 3 forming a cushion of the side surfaces S of the armrest 1.

According to the above configuration, the body pad 3E has both the outer corners of the inverted U shape configured as curved covers 3G that cover the curved surfaces 2E of both outer corners of the base member 2. As shown in FIG. 7, each curved cover 3G continuously covers the curved surface 2E across the upper surface 2D of the top plate 2A and the outer side surface 2G of the side plate 2B.

The stacked pad 3F is provided in a stacked state while being fitted into a recess E1 formed in a top region, which is a region on the top plate 2A of the body pad 3E. The recess E1 is formed to be recessed in a rectangular shape in a plan view from the surface of the pad (the upper side). The stacked pad 3F is cut into a plate shape having a rectangular shape in a plan view along the recessed shape of the recess E1.

The stacked pad 3F is fitted into the recess E1 from above, so that the upper surface thereof is set to be flush with the upper surface of the peripheral edge of the recess E1 of the body pad 3E. As a result, the stacked pad 3F forms a top region of the pad 3 forming a cushion of the upper surface U of the armrest 1 together with the body pad 3E stacked below the stacked pad 3F. The boundary between both side surfaces of the recess E1 and both side surfaces of the stacked pad 3F may be erected perpendicularly, or may be erected obliquely in the width direction, from the top plate 2A of the base member 2 as shown in the drawings. It is preferable that the boundary is positioned on the inner side in the width direction with respect to the seam allowance of the sewn portion at which the cover pieces of the cover 4 are sewn together at both outer corners.

According to the configuration described above, the pad 3 covers the outer peripheral surface of the base member 2 without a gap by the body pad 3E, and reduces the uncomfortable feeling at the time of using the curved surfaces 2E, which are convex edges. Further, the pad 3 is configured such that the top region forming a cushion of the upper surface U of the armrest 1 has a stacked structure of the soft stacked pad 3F and the body pad 3E harder than the soft stacked pad 3F, so that adjustment of the thicknesses thereof enables appropriate adjustment of the cushioning property of the upper surface U of the armrest 1.

The pad 3 is configured such that the soft feeling of the upper surface U of the armrest 1 is enhanced by the softer stacked pad 3F, and the shape of the side surfaces S and the outer corners of the armrest 1 can be appropriately set by the harder body pad 3E. Further, since the stacked pad 3F is supported from the periphery by the body pad 3E, the stability of the support to the arm or the hand placed on the upper surface U can be improved.

The configuration other than the above is substantially the same as the configuration described in the first embodiment. Therefore, the same components as those described in the first embodiment are denoted by the same reference numerals, and description thereof will be omitted.

To summarize the above, the armrest 1 according to the present embodiment may have the following configuration. In the following description, reference numerals assigned in parentheses correspond to the configurations described in the above embodiment.

That is, the pad (3) includes a body pad (3E) forming a cushion of the top region and the side plate region including the outer corner, and a stacked pad (3F) provided in a stacked manner in a recess (E1) recessed from a surface of the pad formed in the top region of the body pad (3E), the stacked pad forming a cushion of the top region together with the body pad (3E). The stacked pad (3F) is softer than the body pad (3E).

According to the above configuration, it is possible to appropriately adjust the cushioning property of the upper surface (U) by overlapping on the body pad (3E) the stacked pad (3F), which is softer than the body pad (3E). Further, since the stacked pad (3F) is supported from the periphery by the body pad (3E), the stability of the support to the arm or the hand placed on the upper surface (U) can be improved.

OTHER EMBODIMENTS

The embodiments of the present invention have been described above with reference to two embodiments, but the present invention can be performed in various embodiments other than the above embodiments.

1. The armrest of the present invention may be not fixed to the side of the seat, but be capable of deploying and retracting by rotation in the front-rear direction on the side of the seat back. Further, the armrest may be configured to be switched to a state in which an arm or hand can be placed by putting down the central portion of the seat back of a so-called bench seat.

The armrest may be provided not to a seat, but to the upper portion of the center console or the door trim of an automobile. Further, the armrest may be provided for a wheeled vehicle other than an automobile of the railway or the like, or for a seat of a vehicle other than a wheeled vehicle, such as an aircraft or a ship. The armrest may be provided not for a vehicle, but for a seat for uses other than a vehicle, such as a seat installed in various facilities such as sports facilities, theaters, concert venues, event venues, and the like, or a massage seat.

2. The pad may be made of not slab urethane or chip urethane, but molded urethane. The pad may be formed by integrally connecting the cushions of the top region and the side plate region. The cover may be made of not synthetic leather, but genuine leather or fabric. The base member may be made of not a resin but a metal.

3. The heater may be not provided with the base fabric but only has the heating wire laid between the pad and the cover. Alternatively, the heater may have a configuration in which the heating wire is laid over not the rear surface but the front surface of the base fabric. Alternatively, the heating wire may be provided separately on both the front surface and the back surface of the base fabric.

4. The curved surface formed on the outer peripheral surface of the base member may be not curved at a right angle, but curved at an obtuse angle or an acute angle, downward from the upper surface of the base member. The curved surface is a surface that may apply a bending load to the heating wire of the heater due to the curved shape thereof. The bending load applied to the heating wire of the heater via the pad is reduced by providing the curved cover of the pad in a manner covering the outer peripheral surface across the curved surface and the upper surface of the base member.

5. The heater may be not provided over substantially the entire region in the front-rear direction of the armrest, but provided only in a partial region in the front-rear direction. For example, in a type in which the armrest is connected to the side of the seat back so as to be deployed and retracted by rotation in the front-rear direction, the armrest tracks the seat back even when the seat back is tilted backward. Therefore, the position where the arm or hand of the seated occupant is placed on the armrest is less likely to be displaced. Therefore, in such a type, the heater is only required to be provided at a specific location of the armrest where the arm or hand is placed. In particular, even if the heater provided on the side surface of the armrest is provided only on the side surface of the region where the hand of the seated occupant is placed, it is possible to appropriately warm the fingertips extending to grip the side surface of the armrest.

Figure 8:
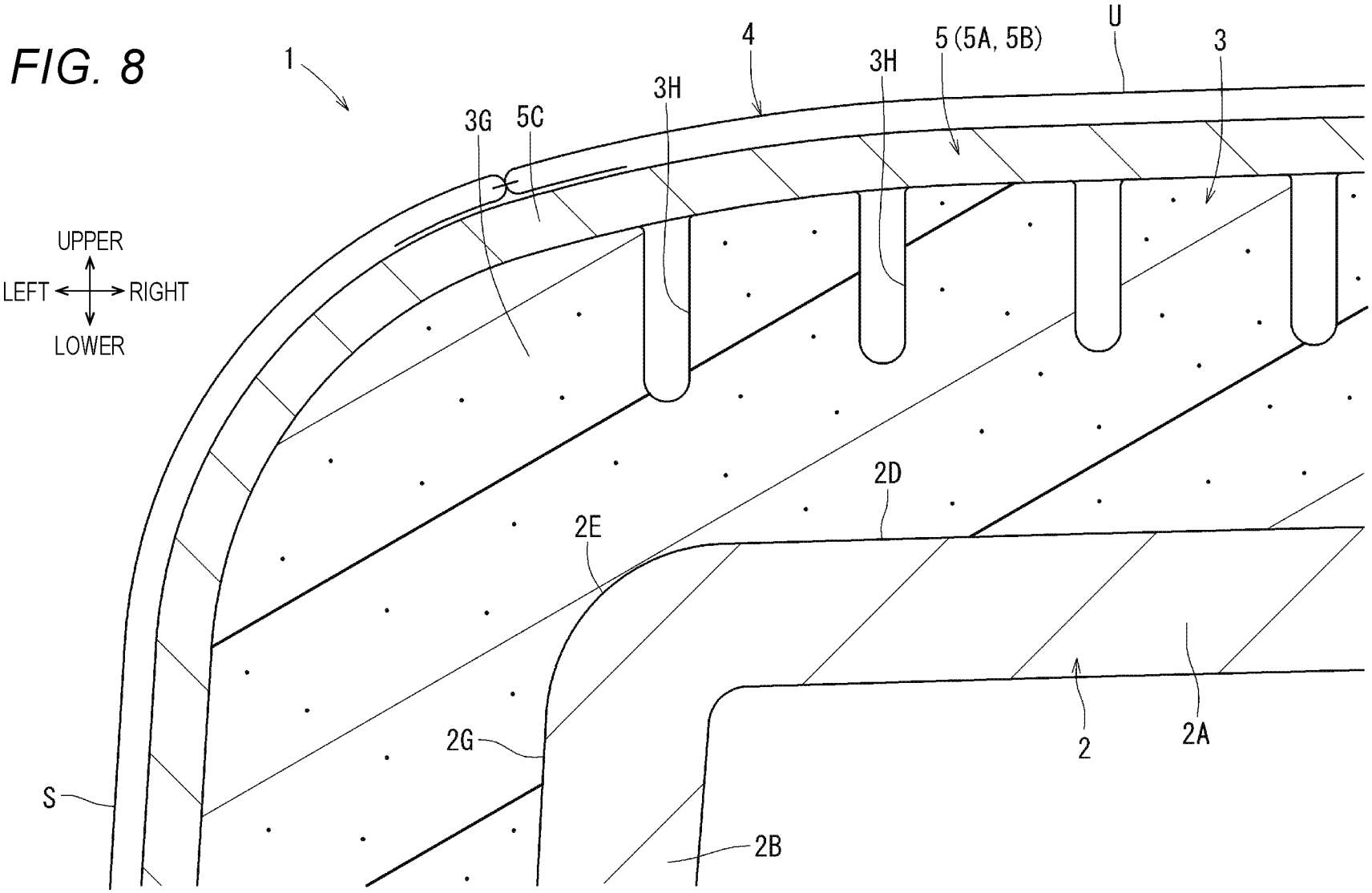
FIG. 8 is a cross-sectional view corresponding to FIG. 3, illustrating a configuration of an armrest according to another embodiment.
Figure 9:
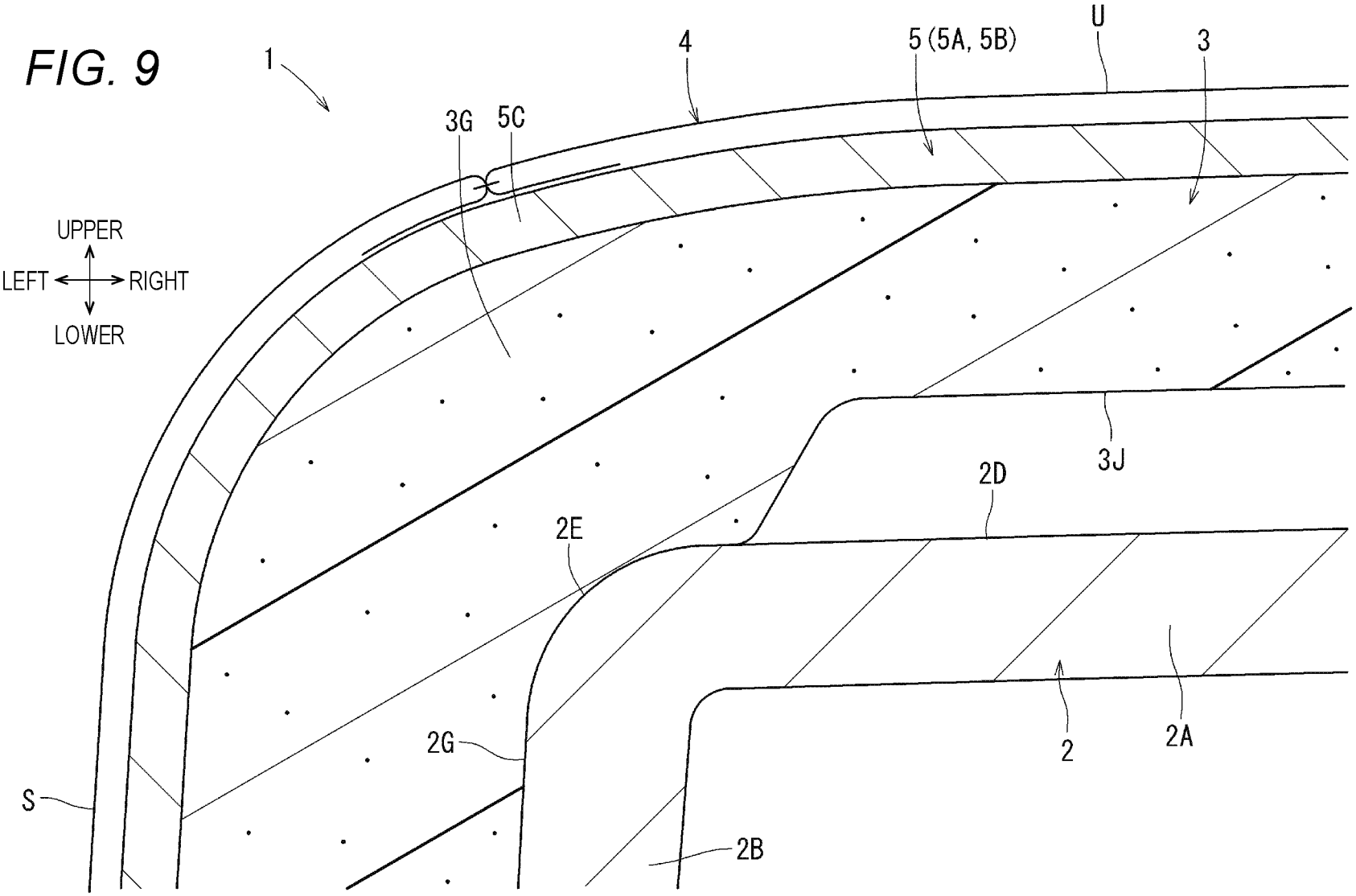
FIG. 9 is a cross-sectional view corresponding to FIG. 3, illustrating a configuration of an armrest according to another embodiment.

6. As shown in FIGS. 8 to 9, the cushioning pad 3 provided on the base member 2 may be constituted by one component made of mold urethane. In this case, the top region on the upper surface 2D of the base member 2 of the pad 3 may be provided with a slit 3H (see FIG. 8) for cutting into the pad 3 from the front surface or a back recess 3J (see FIG. 9) for forming a space between the pad 3 and the upper surface 2D of the base member 2, thereby weakening hard feeling of the top region of the pad 3. In this way, it is possible to appropriately shape the side surface S and the outer corner of the armrest 1 while enhancing the soft feeling of the upper surface U on which the arm or hand of the armrest 1 is placed. Instead of the slit 3H illustrated in FIG. 8, a through hole that penetrates the pad 3 in the thickness direction may be provided.

What is claimed is:

1. An armrest, comprising:

a base member serving as a framework;

a cushioning pad provided on the base member;

a cover wrapping the base member and the cushioning pad; and a planar heater disposed such that an electric heating wire is laid between the cushioning pad and the cover, wherein the base member has an outer peripheral surface having a curved surface that is curved downward from an upper surface of the base member, the cushioning pad has a curved cover that covers the outer peripheral surface of the base member across the upper surface and the curved surface, the heater has a curved portion disposed such that the heating wire is laid between the curved cover and the cover, the curved cover is an outer corner between a top region forming a cushion of the upper surface of the cushioning pad and a side plate region forming a cushion of a side surface in a width direction of the cushioning pad, and the heater is disposed such that the heating wire is laid across the top region and the side plate region of the cushioning pad.

2. The armrest according to claim 1, wherein the cushioning pad includes a top pad forming a cushion of the top region, and a side pad that is immediately adjacent to the top pad in the width direction and that forms a cushion of the side plate region including the outer corner, and the top pad is softer than the side pad.

3. The armrest according to claim 2, wherein a top plate supporting the top pad of the base member is formed with a fitting recess fitted with the top pad.

4. The armrest according to claim 1, wherein the cushioning pad includes a body pad forming a cushion of the top region and the side plate region including the outer corner, and a stacked pad stacked in a recess on the top region of the body pad, the stacked pad and the body pad forming a cushion of the top region, and the stacked pad is softer than the body pad.

* * * * *